US006217402B1

(12) United States Patent
Bolen

(10) Patent No.: US 6,217,402 B1
(45) Date of Patent: Apr. 17, 2001

(54) STABILIZING ELEMENT FOR USE ON MOBILE DEVICES

(76) Inventor: Robert Bolen, 1818 Pine St., Huntington Beach, CA (US) 92648

( * ) Notice: Subject to any disclaimer, the term of this patent is extended or adjusted under 35 U.S.C. 154(b) by 0 days.

(21) Appl. No.: 09/335,463

(22) Filed: Jun. 17, 1999

Related U.S. Application Data

(63) Continuation-in-part of application No. 09/098,400, filed on Jun. 17, 1998, now Pat. No. 6,106,346.

(51) Int. Cl.[7] ..... B63B 1/00
(52) U.S. Cl. ..... 441/79; 114/140
(58) Field of Search ..... 441/65, 74, 79; 114/39.15, 127, 140; 440/67

(56) References Cited

U.S. PATENT DOCUMENTS

| | | | | |
|---|---|---|---|---|
| 3,089,157 | | 5/1963 | May | 441/79 |
| 3,103,673 | | 9/1963 | Martin | 441/79 |
| 3,137,265 | * | 6/1964 | Meyerhoff | 440/67 |

FOREIGN PATENT DOCUMENTS

| | | | |
|---|---|---|---|
| 576896 | 9/1988 | (AU) . | |
| 3509229 A1 | 9/1986 | (DE) . | |
| 2502108 | 9/1982 | (FR) . | |
| 2576867 | 8/1986 | (FR) | 114/127 |
| 2 581 361 A1 | 11/1986 | (FR) . | |
| 2 177 353 | 1/1987 | (GB) . | |
| 8800184 | 8/1989 | (NL) . | |
| 1382736 A1 | 3/1988 | (SU) . | |

* cited by examiner

*Primary Examiner*—Stephen Avila
(74) *Attorney, Agent, or Firm*—Knobbe, Martens, Olson, Bear, LLP.

(57) ABSTRACT

A foil having a stabilizing hollow element, the entire foil forming a wing- or fin-like shape. The hollow element may also have a leading edge that tapers to a defined point. The hollow element may also have a foil shape, running substantially parallel to the foil profile of the fin- or wing-like extensions.

42 Claims, 6 Drawing Sheets

FIG. 8
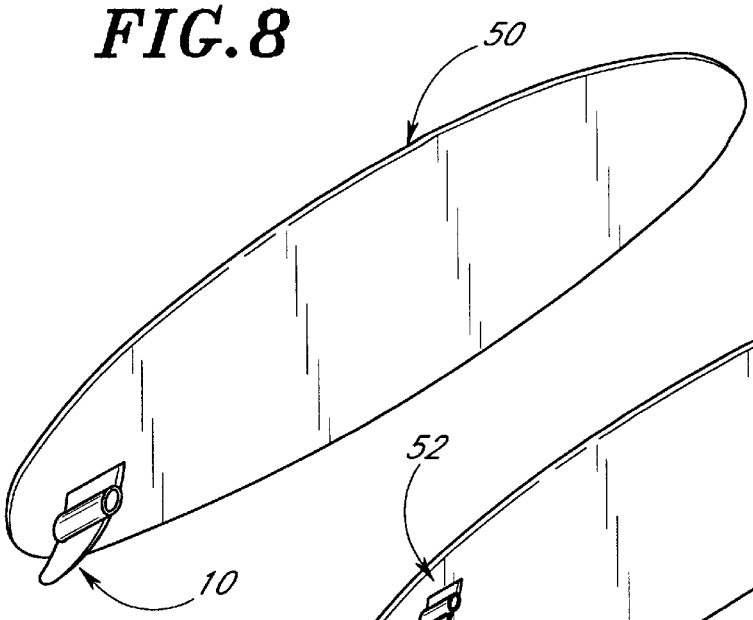
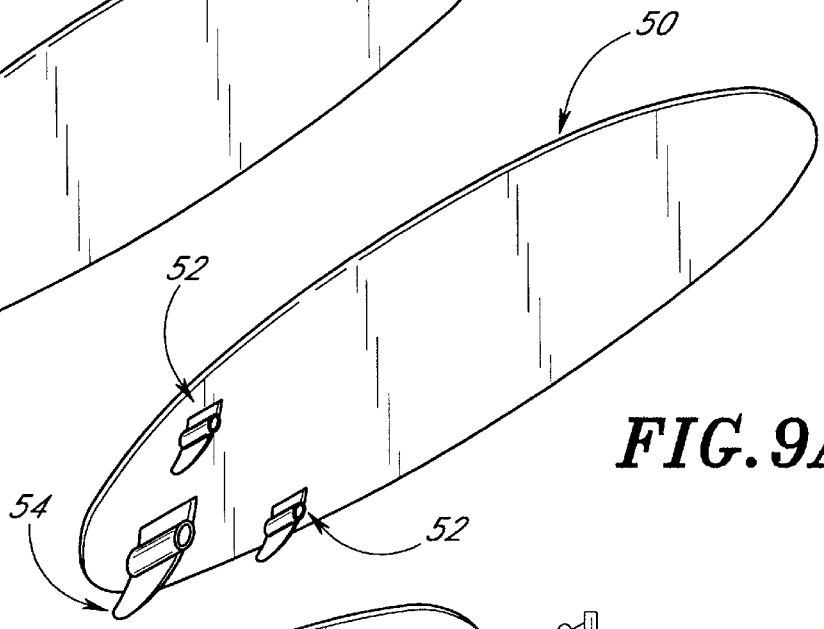
FIG. 9A
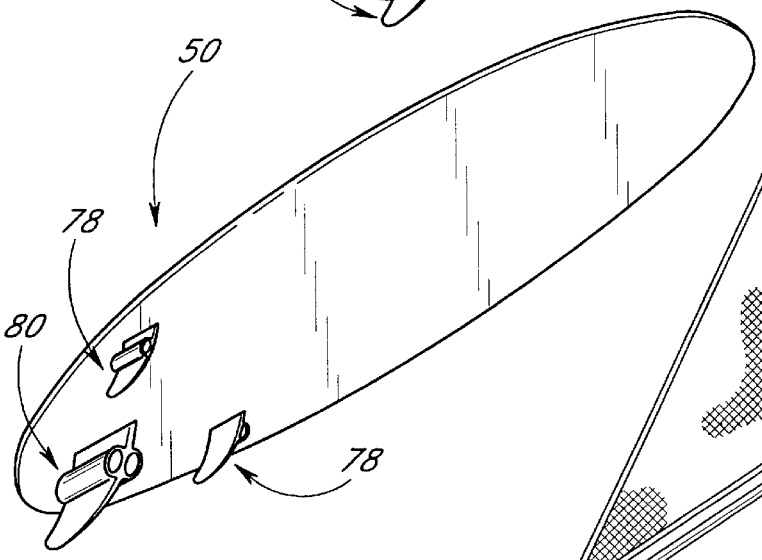
FIG. 9B
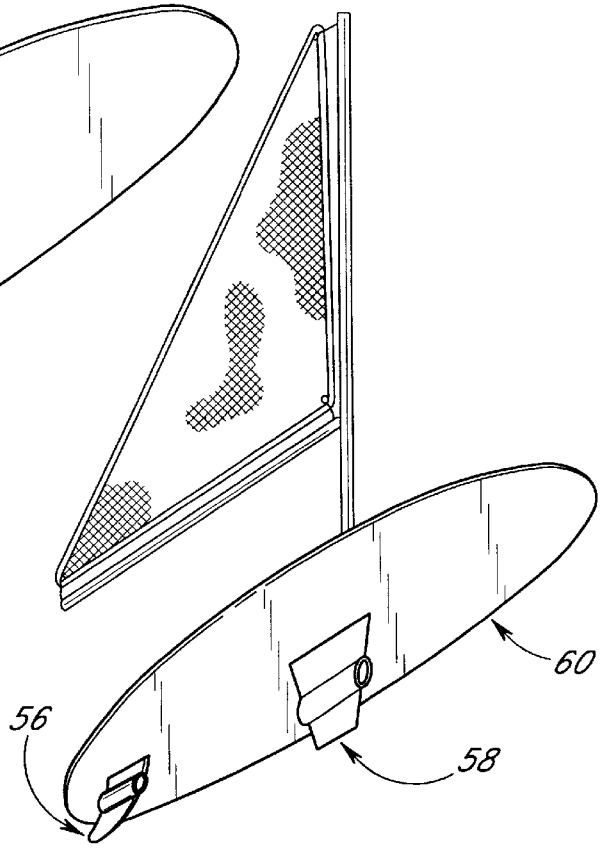
FIG. 10

STABILIZING ELEMENT FOR USE ON MOBILE DEVICES

RELATED APPLICATION

This application is a continuation-in-part of application Ser. No. 09/098,3400, filed Jun. 17, 1998, now U.S. Pat. No. 6,106,346 issued Aug. 22, 2000, entitled Stabilizing Fin For a Water Planing Device.

BACKGROUND OF THE INVENTION

1. Field of the Invention

The present invention relates to an improved foil, such as a fin or wing, having a stabilizing hollow element which increases stability by reducing the effect of turbulence in air or water on mobile devices and which increases maneuverability of such devices.

2. Description of the Related Art

Many mobile devices have a foil, frequently a wing or a fin to stabilize their motion and provide lift. Nearly all types of watercraft use a vertical foil or fin to provide horizontal stability. Sailboats and other large watercraft frequently have a fin that is a direct extension of the hull. Commonly used surfboards and wind surfing boards utilize one or more "shark-like" fins which may extend vertically up to 16 inches in a downward direction below the bottom surface of the surfboard or wind surfing board. This type of fin generally only allows for the stabilization of a boat, surfboard or windsurfing board in the horizontal direction while riding through the water or on a wave under either smooth or rough water conditions. It offers little or no resistance to the vertical rise experienced while performing the various maneuvers common to watercraft. Any maneuver that moves the weight forward and causes the watercraft or board to rise vertically may result in loss of control due to the fin losing contact with the wave or the water and result in a wipe out. Additionally as a wave becomes steeper and prepares to break, this type of fin, having only vertical design, will tend to lose contact with the face of the wave causing the loss of horizontal control allowing the board to slide sideways and cause a wipe out. Waves and turbulent water can also jar speedboats and sailboats or cause them to lose control.

The wings of airplanes or other aircraft have horizontal wings or stabilizers that provide lift and/or vertical stability and/or horizontal stability, but the aircraft is still vulnerable to instability caused by turbulent air. Automobiles may also use a foil or blade appendage, commonly attached at the rear. This rear foil, sometimes known as a spoiler, provides downward force to help the tires maintain contact with the road. Like an airplane wing, however, the spoiler mostly provides stability in only one direction and is subject to the destabilizing effect of turbulent air. In short, most mobile devices have some type of airfoil, wing, or blade-like device which is designed to achieve stability, lift, and/or maneuverability.

Thus there is a need for improved stabilizing elements for use in connection with these types or similar devices.

SUMMARY OF THE INVENTION

In one aspect, the present invention preferably reduces the effect of turbulent air or water upon a moving object, increases stability in a variety of directions and increases lift beyond foils currently in use. In another aspect, the present invention also preferably increases maneuverability of moving object in air, water or on land.

In one embodiment, the stabilizing element attaches to a water planing device or watercraft. The stabilizing fin includes an upper vertical stabilizer element, a hollow tubular element, and a lower vertical stabilizer element. The upper vertical stabilizer element has an upper end for attachment to a bottom surface of a water planing device or watercraft. The hollow tubular element has an upper portion depending from a lower end of the upper vertical stabilizer element. The tubular element has an open front end and an open rear end. The lower vertical stabilizer element has an upper end depending from a lower portion of the hollow tubular element. During use thereof the upper and lower vertical stabilizer elements provide lateral stability and the hollow tubular element provides increased lateral stability and vertical stability for enhanced control by a user. The water planing device may be, for example, a surfboard or a wind surfing board. The watercraft may also be a sailboat or speedboat.

The stabilizing fin stabilizes the water planing device or boat in a variety of directions under a variety of conditions. For example, this element gives the surfboard or windsurfing rider longer more controlled rides while performing on the nose area of a surfboard by holding the tail section down in the water. This element also gives the rider of the surfboard or a wind surfing board more control while riding through, in, or over the white water sections of waves while performing a variety of maneuvers. It gives the rider more control while riding on water or up or down face of a step wave on either a surfboard or a wind surfing board during either rough or smooth conditions. The stabilizing fin stabilizes other watercraft in waves or turbulent water.

In accordance with one aspect of the present invention, an increase in maneuverability is attained by the leading edge of the hollow element tapering to a defined edge. It is believed that this defined edges aids the moving object in initializing a turn by biting into the fluid.

In another embodiment, the hollow element, as it extends through the entire foil, maintains the foil shape of the entire fin or wing. This foil shape of the hollow element provides greater lift on the mobile object by creating more surface area against which the water or air may flow.

In another embodiment, the stabilizing element attaches to an aircraft. The wing of the aircraft has a hollow stabilizing element that helps provide additional lift and stability beyond wings currently in use.

In another embodiment, the stabilizing element attaches to the rear of an automobile, as a spoiler. Automobile spoilers are generally arranged to provide downward force to the rear tires, helping the tires remain in contact with the ground. The hollow element increases the surface area beyond commonly used spoilers, thereby allowing the spoiler to create more downward force without requiring greater length. In addition, the hollow element provides horizontal stability by channeling air through the body of the hollow element. It is also believed that the element increases maneuverability as the front edge of the hollow element is tapered to a defined edge.

BRIEF DESCRIPTION OF THE DRAWINGS

FIG. 8 is a perspective view of a surfboard with one embodiment of the stabilizing fin of the present invention attached thereto.

FIG. 9A illustrates a surfboard with an arrangement of another type of stabilizing fin.

FIG. 9B illustrates another arrangement of stabilizing fins on a surfboard.

FIG. 10 illustrates use of the stabilizing fins on a wind surfing board.

The same reference characters designate the same parts or elements throughout the drawings.

DETAILED DESCRIPTION OF THE PREFERRED INVENTION

Figure 18:
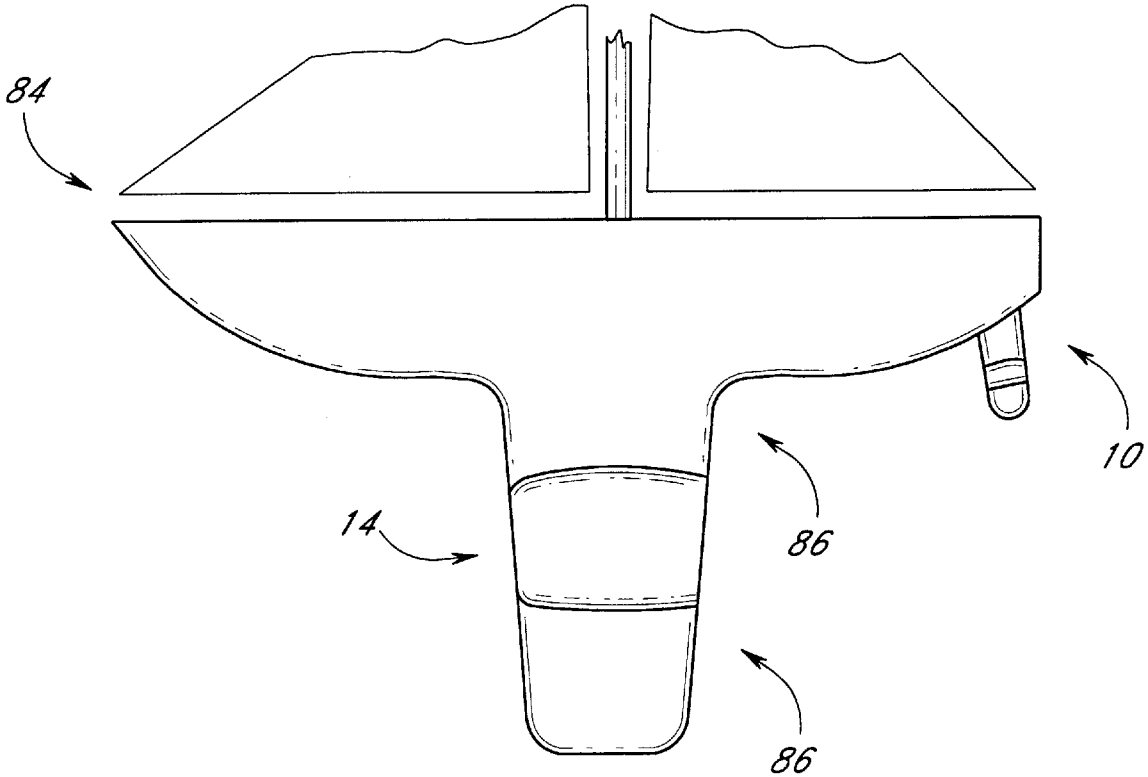
FIG. 18 is a side view of the sail boat of FIG. 17, with a large hollow element contiguous with the hull and a smaller stabilizing fin attached at the rear of the boat.
Figure 19:
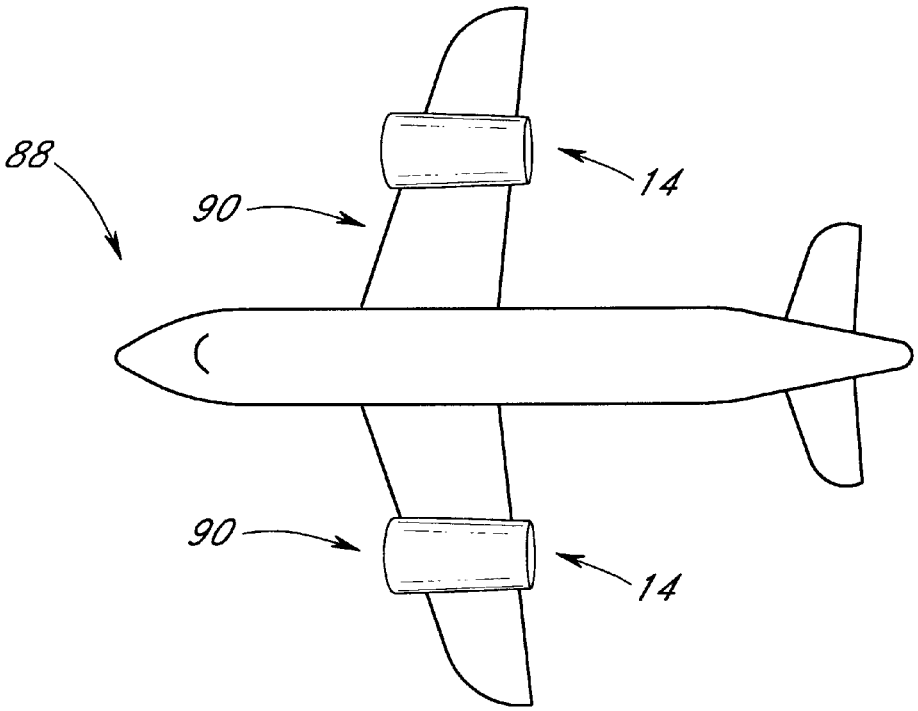
FIG. 19 is a top view of an airplane, where two foil with a hollow element make up the wings of the airplane.

Referring now to the drawings and the characters of reference marked thereon, FIGS. 1–7 illustrate a first embodiment of the present invention, designated generally as 10. Stabilizing fin 10 includes an upper vertical stabilizer element 12, a hollow tubular element 14 and a lower vertical stabilizer element 16. The upper vertical stabilizer element is generally shaped as a single vertically oriented plate or blade having a generally planar configuration. It has an upper end 18 which attaches to a bottom surface of a water planing device (not shown). It may be attached by means well known in the art (either permanently affixed or removable). The upper vertical stabilizer element 12 may also be contiguous with the bottom surface or hull of a sailboat, as shown in FIGS. 18–19.

The hollow tubular element 14 has an upper portion 20 which depends from a lower end 22 of the upper vertical stabilizer element 12. The tubular element 14 has an open front end 24 and an open rear end 26. The hollow element is a three dimensional shape having an upper outer surface 70, a lower outer surface 72, an upper interior surface 74, and a lower interior surface 76.

Figure 4:
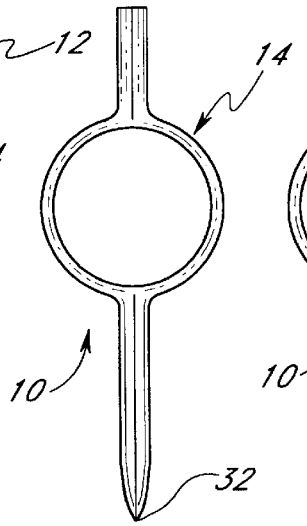
FIG. 4 is a rear end view of this embodiment.
Figure 5:
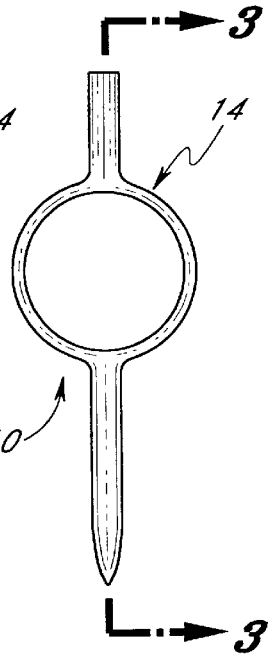
FIG. 5 is a front end view, of the stabilizing fin of FIGS. 1 and 2.
Figure 6:
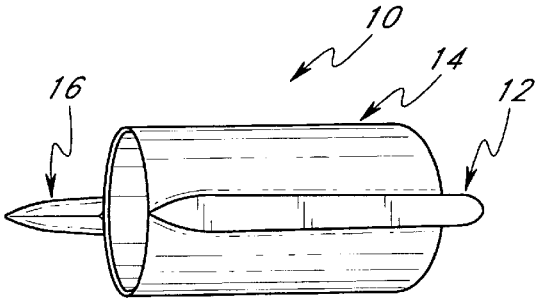
FIG. 6 is a top rear perspective view of the stabilizing fin.
Figure 7:
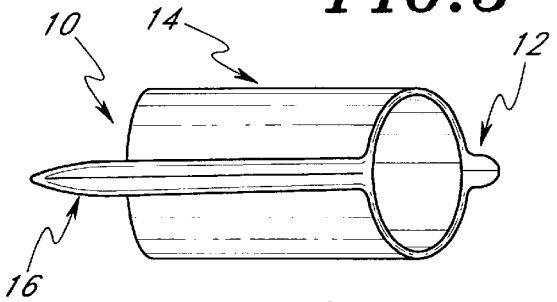
FIG. 7 is a bottom, front perspective view of the stabilizing fin.

As can be seen in FIGS. 4 and 5, the hollow tubular element 14 is symmetrical about its center line. In this preferred embodiment, the hollow tubular element 14 has a substantially circular cross-section. Although the hollow element is tubular in this embodiment, the opening or passageway need not be tubular in shape.

The lower vertical stabilizer element 16 has an upper end 28 depending from a lower portion 30 of the hollow tubular element 14. The upper vertical stabilizer element 12, the hollow tubular element 14 and the lower vertical stabilizer element 16 are preferably integrally connected. They may be formed of typical surfboard fin materials such as fiberglass, injection-molded plastic, and carbon fiber composites. The combination of shapes required by the stabilizing fin 10 particularly lend themselves to recent advances in carbon composite manufacturing processes.

The front end of the hollow tubular element 14 preferably has a rounded leading edge and the rear end thereof preferably has a tapered trailing edge. Similarly, as can be seen in FIGS. 4 and 5, the upper vertical stabilizer element 12 and the lower vertical stabilizer element 16 have rounded leading edges and tapered trailing edges. The edges of the lower vertical stabilizer element 16 converge at a lower end 32 thereof.

Figure 1:
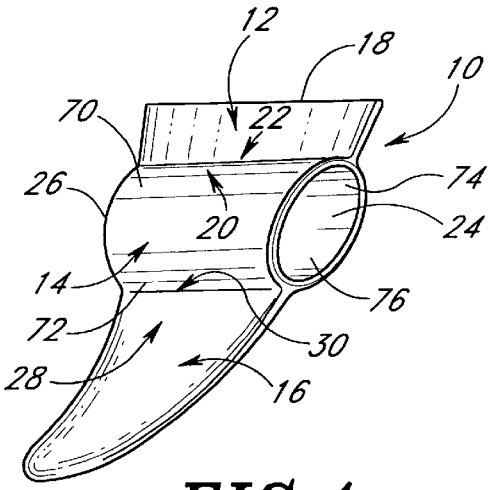
FIG. 1 is a front, side perspective view of the stabilizing fin of an aspect of the present invention.
Figure 2:
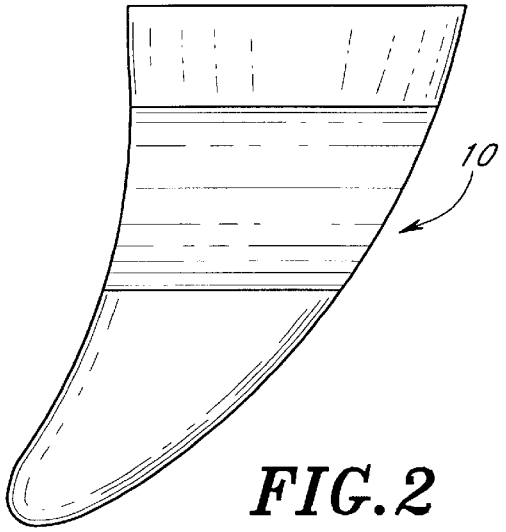
FIG. 2 is a side perspective view of the stabilizing fin.
Figure 3:
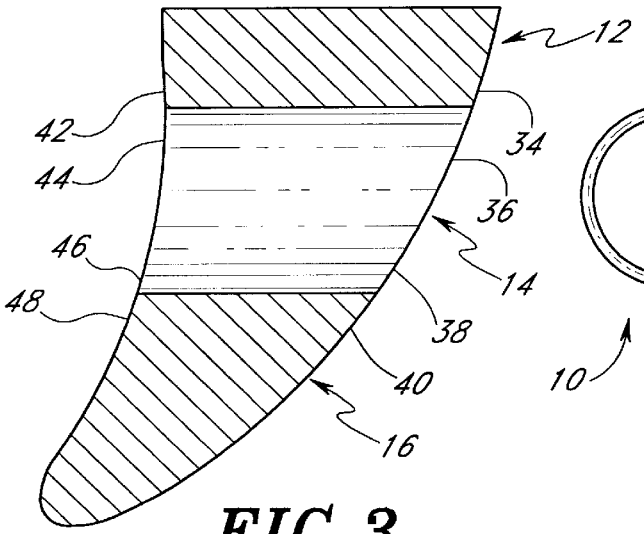
FIG. 3 is a cross-sectional view of the stabilizing fin of 1 and 2, taken along line 3—3 in FIG. 5.

As can be seen, for example in FIG. 3, a lower front portion 34 of the upper vertical stabilizer element 12 is contiguous with an upper front portion 36 of the hollow tubular element 14. A lower front portion 38 from the hollow tubular element 14 is contiguous with an upper front portion 40 of the lower vertical stabilizer element 16. Furthermore, a lower rear portion 42 of the upper vertical stabilizer element 12 is contiguous with an upper rear portion 44 of the hollow tubular element 14. A lower rear portion 46 of the hollow tubular element 14 is contiguous with an upper rear portion 48 of the lower vertical stabilizer element 16. Thus, as can be seen in for example in FIG. 3, a continuous curve side profile is provided.

For a surfboard, the distance from the top of the upper vertical stabilizer element 12 to the bottom of the lower vertical stabilizer element 16 may typically be around 3 inches to about 12 inches. For a wind surfing board this distance may be up to about 15 inches.

The upper vertical stabilizer element 12 may have a width on the order of about 4 inches to 6 inches.

The lower vertical stabilizer element 16 may have a width that tapers from about 3 inches at the upper end down to the tip or perhaps as much as say about 6 inches down to the tip.

The hollow tubular element 14 may have a diameter of about 1 inch to about 3 inches for applications with a surfboard. This diameter may be substantially increased for applications on a wind surfing board.

Referring now to FIG. 8, application of the stabilizing fin 10 of the present invention is illustrated on a typical application on a surfboard 50.

FIG. 9A shows an alternate arrangement of the stabilizing fin on a surfboard 50. In this instance, two relatively small stabilizing fins 52 are positioned side-by-side forward a relatively large fin 54 near the back of the surfboard 50. This fin configuration provides an enhanced stabilizing effect on relative large steep waves. As noted above, the stabilizing fins may be permanently affixed to the board or removable and adjustable to, for example, the configuration shown in FIG. 9A.

FIG. 9B shows a surfboard 50 with an arrangement of another type of stabilizing fin. The two forward fins 78 have a hollow element attached on one side. As illustrated in FIG. 9B, the rear fin 80 has two hollow elements, one at each side of the fin. However, in another embodiment (not shown), the rear fin is a regular straight fin, without a hollow element, and the two forward fins 78 have hollow elements attached on the outward facing side. The arrangement shown and described in relation to FIGS. 9 and 9*a* may also be used on a windsurfing board or other water planing device.

FIG. 10 shows implementation of stabilizing fins, 56, 58 on a wind surfing board 60. Stabilizing fin 58 is attached near the center of the wind surfing board. Stabilizing fin 56 is attached near the rear of the board. This arrangement is shown by way of example. There are many different configurations of stabilizing fins that can be adapted in accordance with the principles of the present invention.

Figure 11:
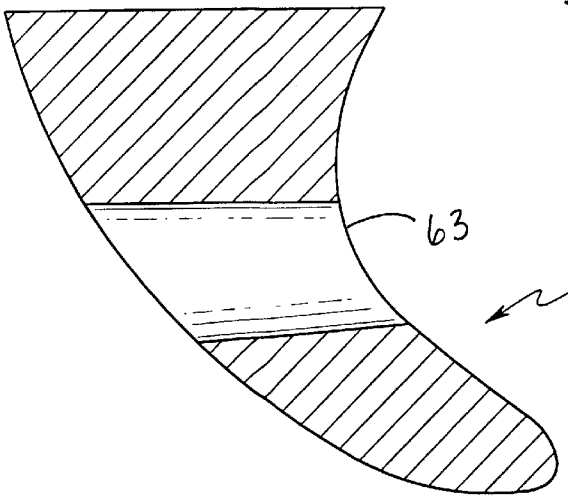
FIG. 11 is a cross-sectional view of an alternative stabilizing fin, which is more greatly swept back than the FIG. 1 embodiment.

FIG. 11 shows a stabilizing fin 62 with a fin profile which is swept back to a greater degree than the FIG. 1–7 embodiment. This is useful for creating a more drawn out turn. Additionally, this fin is more suitable for surfing in areas with an abundance of kelp, seaweed and rocks. As is shown in FIG. 11, the hollow stabilizing element 63 can extend completely from the leading edge of the fin 62 to the trailing edge thereof; or, alternatively, the element 63 can extend only partway from the leading edge toward the trailing edge with side vents or exhausts allowing the exit of fluid from the fin. In another embodiment (not shown), the stabilizing element 63 can extend partway from the trailing edge toward the leading edge.

Figures 13, 14:
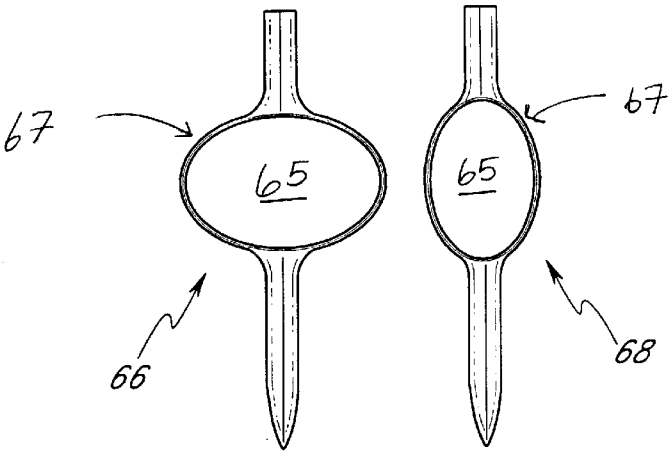
FIG. 13 is a rear end view of yet another embodiment which has a hollow tubular element with an elliptical shape.
FIG. 14 is a rear end view of another embodiment where the elliptical tubular element is oriented 90 degrees from the FIG. 13 embodiment.
Figure 12:
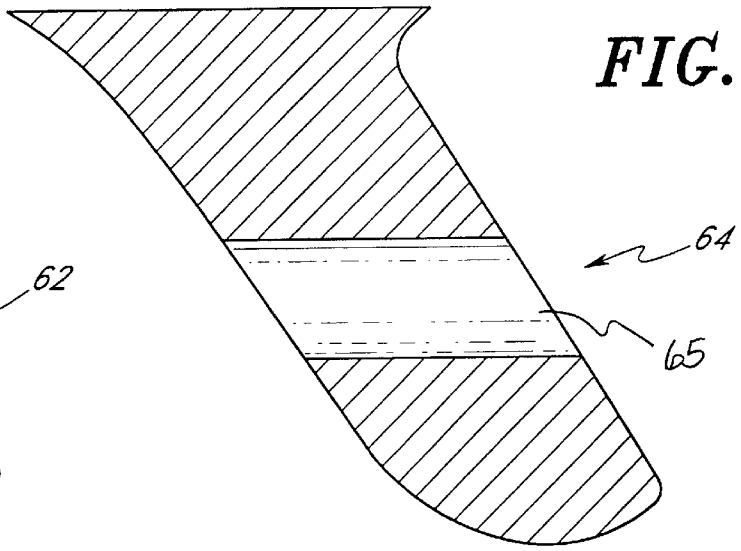
FIG. 12 is a cross-sectional view of another fin profile which is more vertically oriented than the FIG. 1 embodiment.

FIG. 12 illustrates a stabilizing fin 64 with a fin profile, which is more vertical than the other embodiment to create more of a pivot turn. Although only two fin shapes are shown, the stabilizing fin may be attached to any shape, size of thickness of fin, blade, airfoil, and the like. In addition, although the stabilizing element 65 is shown in FIG. 12 as being symmetrical, it may also take on an asymmetrical configuration, such as one having an airfoil shape in cross section. Such a configuration can have the effect of producing a lift on the fin, both due to the flow of fluid over the outer extremities of the hollow element 65 as well as the flow of fluid through its interior. The outer extremities 67, of the element 65 are shown better in FIGS. 13 and 14, which illustrate non-circular cross sectional elements. Thus, the element may be incorporated into a fin, blade, airfoil, and the like, in such a manner as to extend outwardly away from the fin, as shown in FIGS. 13 and 14, or may be incorporated therein to more closely align itself with the sides of the fin, as would be more the case in a sailboat fin shown in FIG. 17. That is, the effects of the element, as explained herein, stem both from its interior surfaces as well as its extending surfaces, if any.

Although the hollow tubular element 14 has been shown with a generally circular cross-section, it may have other shapes although these other shapes should be symmetrical about the center line to provide the best stability. For example, referring now to FIG. 13, a fin 66 is shown with an elliptical hollow tubular element. FIG. 14 shows another "elliptical" embodiment, designated generally as 68, with the ellipse oriented in another position.

The hollow tubular element in all these instances may serve as a device for connecting the surfboard to a rack or other permanent fixture for locking purposes. In addition, the element may be mounted on a mobile device by single or plural blades or fins, or may be cantilevered therefrom.

Figure 15:
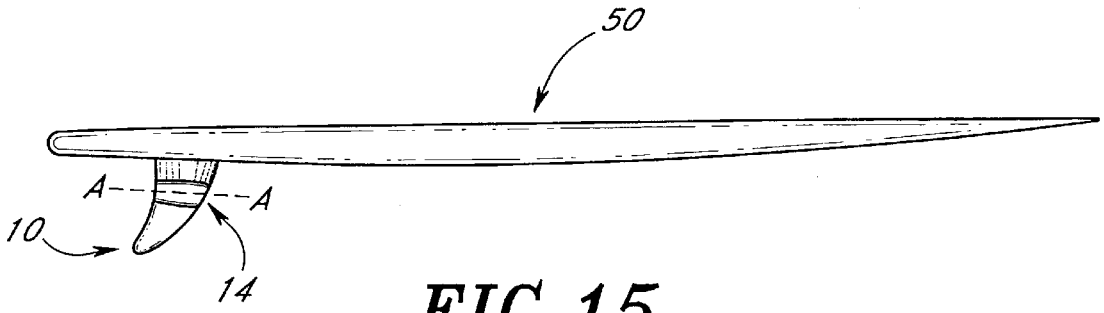
FIG. 15 is a side view of a stabilizing fin mounted on a surfboard.

FIG. 15 shows a side view of a surfboard 50 with a stabilizing fin 10 mounted on the underside of the board. The stabilizing fin 10 in this embodiment provides a force that holds the tail down, helping stabilize the board in waves and turbulent water and allowing the rider to move toward the front of the board. As illustrated in FIG. 15, the underside of a surfboard or windsurfing board usually has rocker, meaning the board curves up from the midpoint of the board, curving up at both the nose and the tail. This rocker or curve keeps the hollow element 14 at a slight downward angle A—A, causing water to deflect off the top exterior surface 70 and the bottom interior surface 76 of the hollow element. This water deflection maintains a slight downward force even when the board is at a natural position.

When the nose of the surfboard dips down and the tail tips up, from wave action or the rider's weight, the hollow element and fin begin to tilt further down. The more the hollow element angles down, the more the top exterior surface 70 of the hollow element resists against the direction of flow as more of the full top exterior surface 70 opposes the forward velocity. This downward force pulls the tail back down into the water. As the downward angle from tail to nose gets steeper and the angle of the hollow element increases, the more downward force the stabilizing fin will exert upon the tail. As a result, the stabilizing fin allows a surfer to ride the nose longer. In addition, the destabilizing effect of turbulence and wave action is minimized. Once the board is no longer at an angle and the nose no longer points down, the hollow element will not drive the board's tail down. This same principle can be used in other watercraft to decrease the effect of turbulence, helping the craft glide more smoothly and efficiently by holding the underside of the craft to the surface of the water.

Figure 16A:
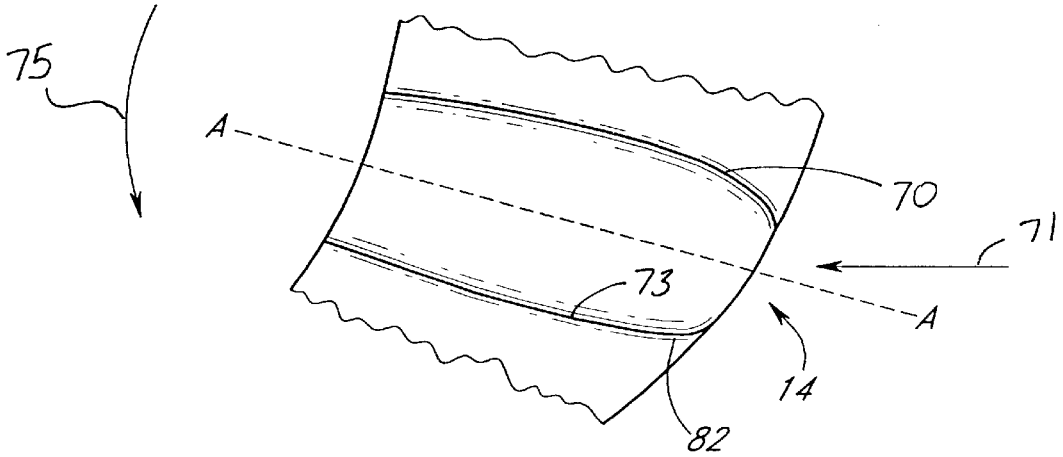
FIG. 16A and 16B are side views of the hollow portion of a foil.

The stabilizing hollow element 14 shown in FIG. 16A has a bottom leading edge 82 that curves upward, towards the center of the hollow element. The upwardcurved leading edge counteracts the downward pull of the stabilizing element. When the tail of the water planing device dives into the water, such as when the surfer turns or otherwise puts his or her weight on the tail of the surfboard, thus putting the tail into the water at an angle, curved edge provides counteracting lift. The greater the angle that the tail dips into the water, the greater upward force this feature creates, preventing the hollow element from driving the tail of the water planing device too deep below the water's surface.

In general, the hollow tubular element provides an increased wetted surface area of the fin. The continuous water flow around and through the increased wetted surface areas of the stabilizing fin allow for more control of surfboards and wind surfing boards in all directions (both vertical and horizontal components) while the operator is directing the surfboard or wind surfing board through the water or up and down the face of the wave. The curve of the hollow element allows it to hold on to a curving or breaking wave, where a similar wing-like stabilizing element only cuts across the wave.

The three dimensional shape of the stabilizing fin increases surface area against which water flow can exert its force. The circular or rounded shape of one embodiment allows the surface area to create force when the board and fin tilt in any number of directions. Thus, the hollow element provides stability in a variety of directions, beyond the single direction foils in use generally provide. In addition, these principles also apply to the other applications of the stabilizing element, such as for example, on aircraft, automobiles, etc.

The hollow shape of one aspect of the invention nearly always allows two surfaces to be exposed to the water flow (upward or downward depending on the tilt of the board). Generally, fluid can exert force against both an exterior surface and an opposite interior surface of the hollow element, providing stability and lift in a variety of directions. As a result, water can exert more force against a fin with the hollow stabilizing element than water could against a fin that extended only horizontally through the main fin, having a single surface. The hollow element can also channel fluid through its length, thus minimizing the effect of turbulent flow on the moving object as a whole.

In another aspect, the stabilizing fin also aids turning. For example, when a surfer begins a turn, the surfer steps back to the tail of the board, pushing the tail down and bringing the nose up. When the rider's weight is on the rear of the board and the rider begins to lean the board to one side to make the turn, the upper interior surface 74 of the hollow element becomes more exposed to the force of the water's velocity. As that surface becomes more exposed, the water flow exerts an upward force on the tail, helping lift the tail of the board out of the water and making the turn smoother and easier. Furthermore, as the rider leans the board to one side to begin a turn, the lean of the board exposes the side interior surface of the hollow element, pushing against the side corresponding to the direction of the turn. As a result of water flow against the upper interior surface 74 and a side portion of the upper inside surface 74, turning is easier and smoother.

In another embodiment, the hollow element tapers to a defined edge at the leading edge and at the trailing edge. This tapered shape mirrors the foil shape of a fin or wing. The interior of the hollow element is straight, not foiled. It is believed that the straight interior creates a vortex within the aperture, giving increased stability and creating increased maneuverability.

In one aspect, illustrated in FIG. 16A, the position of the tunnel below the surface of the water allows the stabilizing element to reach below the choppy or turbulent water to smooth water below. In this illustration, the tail of the surfboard is tending to rise out of the water, which occurs when the surfer, for example , is riding near the nose of the board. In this case, the force of the water fluid, as illustrated by arrow 71, is incident at the leading edge of the hollow element 14 such that it deflects off of the lower, interior surface 73 of the element 14. This deflection causes the element, and therefore the fin and board itself, to be forced downward, as illustrated by the arrow 75, thereby tending to right itself or correct the rocking motion. This effect allows the surfer to ride on the nose longer or otherwise maintain a more stable ride. In addition, there is a propulsive effect (for example, the forces that may arise from the venturi effect of the element) from the water streaming out of the back of the hollow element, tending to give the surfer the feel that greater speed is achieved.

Figure 16B:
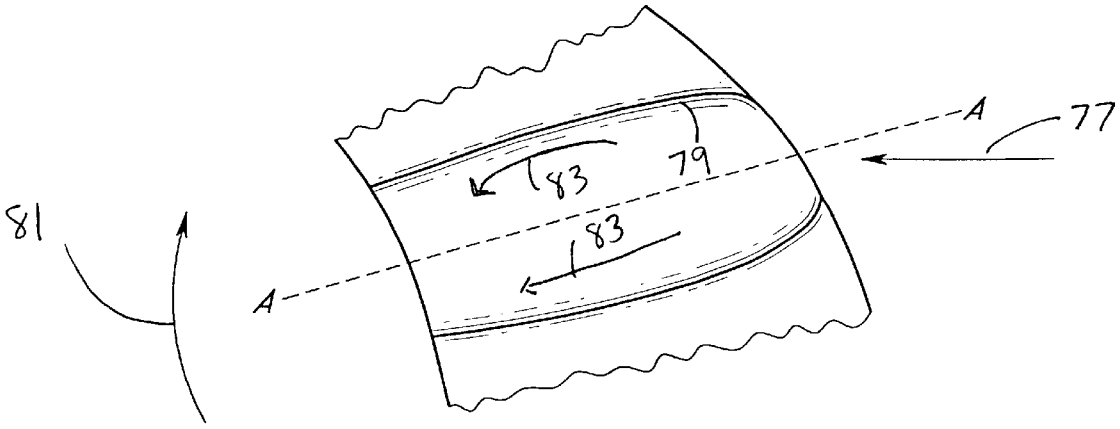

Likewise, as shown in FIG. 16B, if the surfer is riding at the tail of the surfboard or otherwise causes the tail to dive further into the water, the element has the effect of counteracting this opposite rocking or rotational movement. Thus, the water flow 77 impinges on upper interior surface 79 of the element 14 causing a corrective force on the surfboard as shown by arrow 81. Arrows 83 in FIG. 16B also illustrate the interior airfoil effect achieved by the water flow in the element, further enhancing the lift effect achieved by the element. This same lift effect could also be achieved on the exterior surfaces of the element if extending away from the fin, as shown in FIGS. 13 and 14.

In one embodiment, the stabilizing fin 10 is a surfboard fin, as shown in FIG. 16, that extends about eight inches below the underside of the surfboard. The fin has a mounting element (not shown) that is 0.75 inches tall and 6.25 inches from leading to trailing edge. The upper vertical stabilizer element 12 extends 1.25 inches below the board's surface and is 4.5 inches long at its midsection. The hollow element 14 has an approximately constant diameter of 1.5 inches and is 3.5 inches from its leading to trailing edge. The lower vertical stabilizer element 16 sweeps back behind the hollow element 14, with its trailing end 4.5 inches behind the trailing end of the hollow element 14. The length of the lower stabilizer element 16 is about seven inches from the lower portion 30 of the hollow element 14 to the tip of the fin.

Figure 17:
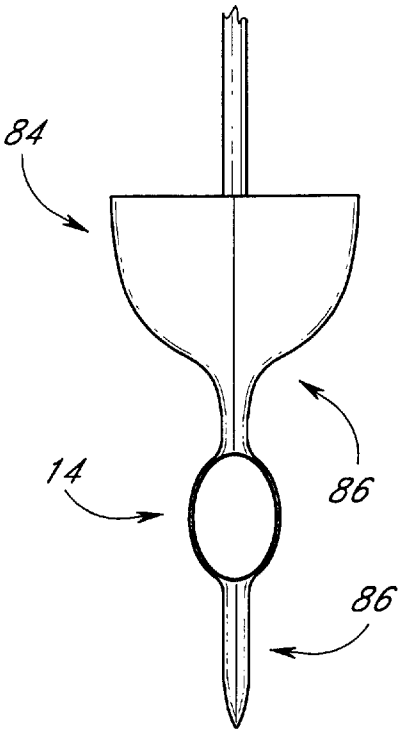
FIG. 17 is a front view of a sailboat, with the upper end of the fin contiguous with the hull or keel of the boat.

FIGS. 17 and 18 illustrate a sailboat 84 with a hollow element 14 extending from the hull 86 of the boat. FIG. 18 shows an embodiment where a small stabilizing fin 10 attaches to the rear of the boat. The hollow element stabilizes the boat in more directions than the keels currently in use. The stabilizing element gives the keel another edge to prevent up and down movement from choppy water, with minimal horizontal extension. Therefore, the stabilizing element smoothes the ride, making the boat more efficient.

FIG. 19 shows an airplane 88 with hollow stabilizing elements 14 attached to each wing 90. The stabilizing element will make turning and gliding easier by cutting down on turbulence in a variety of directions. As a result, aircraft would travel more smoothly and get better gas mileage by eliminating turbulence that detracts from forward motion.

Figure 20:
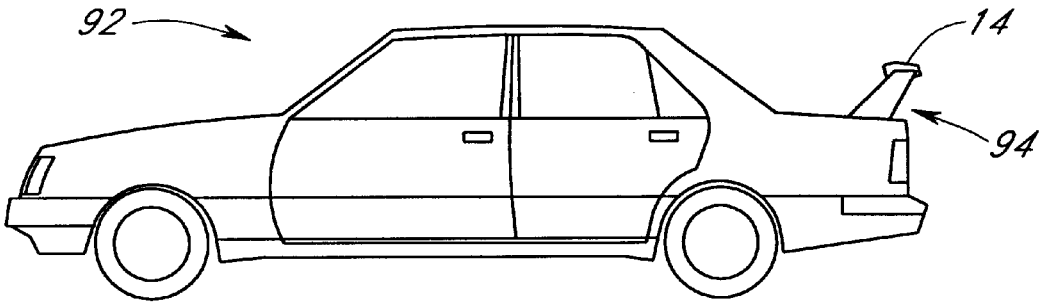
FIG. 20 is a side view of an automobile, with the stabilizing element attached at the rear.

FIG. 20 shows an automobile 92 with a rear spoiler 94. In this embodiment, a hollow stabilizing element 14 is attached at the center of the spoiler 94. Although a spoiler with a single hollow element is shown, the spoiler could have two or more stabilizers. In an embodiment with two stabilizers, the stabilizers could be attached at the edges of the spoiler.

The hollow element could also be placed on a pivoting spoiler or on a fixed spoiler. A spoiler with this aperture has more area for wind resistance, slowing automobile when required and providing downward force, without requiring two fins. The hollow element also helps eliminate turbulence as the automobile rounds corners, giving the driver more control. The stabilizing device can be attached from a center hollow element on a pedestal.

Many modifications and variations of the present invention are possible in light of the above teachings. Furthermore, the principles explained in connection with the surfboard embodiments are also applicable to the other mobile devices shown as well as others. It is, therefore, to be understood that within the scope of the appended claims, the invention may be practiced otherwise than as specifically described.

What is claimed is:

1. A stabilizing fin for a water planing device, comprising:

an upper vertical stabilizer element having an upper end for attachment to a bottom surface of a water planing device;

a hollow tubular element having an upper portion depending from a lower end of said upper vertical stabilizer element, said tubular element having an open first end and an open second end, wherein the circumference of the first end is larger than the circumference of the second end, and wherein the circumference of the tube between said first and second ends exceeds the circumference at either said first end or said second end, and wherein the interior surface of said hollow tubular element forms a curved surface between said first and said second ends; and a lower vertical stabilizer element having an upper end depending from a lower portion of said hollow tubular element, wherein during use thereof said upper and lower vertical stabilizer elements provide lateral stability and said hollow tubular element provides increased lateral stability and vertical stability for enhanced control by a user.

2. The stabilizing fin of claim 1, wherein said first end of said hollow tubular element comprises a rounded edge and wherein said second end of said hollow tubular element comprises a tapered edge.

3. The stabilizing fin of claim 1, wherein said hollow tubular element has a substantially circular cross-section.

4. The stabilizing fin of claim 1, wherein said hollow tubular element has an elliptical cross-section.

5. The stabilizing fin of claim 1, wherein said upper vertical stabilizer element comprises a single vertically oriented plate.

6. The stabilizing fin of claim 5, wherein said upper vertical stabilizer element includes a rounded leading edge and a tapered trailing edge.

7. The stabilizing fin of claim 5, wherein said lower vertical stabilizer element comprises a rounded leading edge and a tapered trailing edge which converge at a lower end thereof.

8. The stabilizing fin of claim 1, wherein said upper vertical stabilizer element, said hollow tubular element and said lower vertical stabilizer element are integrally connected.

9. The stabilizing fin of claim 1, wherein said water planing device comprises a surfboard.

10. The stabilizing fin of claim 1, wherein said water planing device comprises a windsurfing board.

11. The stabilizing fin of claim 1, wherein the circumference of said tubular element between said first end and said second end exceeds the circumference of the tubular element at both said first end and said second end.

12. The stabilizing fin of claim 1 wherein said first end is the front end of said hollow tubular element and wherein said second end is the rear end of said hollow tubular element.

13. The stabilizing fin of claim 1 wherein said first end is the back end of said hollow tubular element and wherein said second end is the front end of said hollow tubular element.

14. The stabilizing fin of claim 1, wherein said water planing device comprises a sailboat.

15. The stabilizing fin of claim 1, wherein the outside surface of said hollow tubular element comprises a curved surface following the contour of said interior surface.

16. A stabilizing fin for a water planing device, comprising:

an upper vertical stabilizer element having an upper end for attachment to a bottom surface of a water planing device; and a hollow tubular element having an upper portion depending from a lower end of said upper vertical stabilizer element, said tubular element having an open first end and an open second end, and a lower vertical stabilizer element having an upper end depending from a lower portion of said hollow tubular element;

wherein during use thereof said upper and lower vertical stabilizer elements provide lateral stability and said hollow tubular element provides increased lateral stability and vertical stability for enhanced control by a user; and wherein a lower front portion of said upper vertical stabilizer element is contiguous with an upper front portion of said hollow tubular element, a lower front portion of said hollow tubular element is contiguous with an upper front portion of said lower vertical stabilizer element, a lower rear portion of said upper vertical stabilizer element is contiguous with an upper rear portion of said hollow tubular element, and a lower rear portion of said hollow tubular element is contiguous with an upper rear portion of said lower vertical stabilizer element, thereby providing a continuous curve side profile for said stabilizing fin.

17. The stabilizing fin of claim 16, wherein said first end of said hollow tubular element comprises a rounded edge and wherein said second end of said hollow tubular element comprises a tapered edge.

18. The stabilizing fin for water planing device of claim 17, wherein said first end is the front end of said hollow tubular element and wherein said second end is the rear end of said hollow tubular element.

19. The stabilizing fin for water planing device of claim 17, wherein said first end is the rear end of said hollow tubular element and wherein said second end is the front end of said hollow tubular element.

20. The stabilizing fin of claim 16, wherein said hollow tubular element has a substantially circular cross-section.

21. The stabilizing fin of claim 16, wherein said hollow tubular element has a substantially elliptical cross-section.

22. The stabilizing fin of claim 16, wherein said upper vertical stabilizer element comprises a single vertically oriented plate.

23. The stabilizing fin of claim 22, wherein said upper vertical stabilizer element includes a rounded leading edge and a tapered trailing edge.

24. The stabilizing fin of claim 22, wherein said lower vertical stabilizer element comprises a rounded leading edge and a tapered trailing edge which converge at a lower end thereof.

25. The stabilizing fin of claim 16, wherein said upper vertical stabilizer element, said hollow tubular element and said lower vertical stabilizer element are integrally connected.

26. The stabilizing fin of claim 16, wherein said water planing device comprises a surfboard.

27. The stabilizing fin of claim 16, wherein said water planing device comprises a windsurfing board.

28. The stabilizing fin of claim 16, wherein said water planing device comprises a sailboat.

29. The stabilizing fin of claim 16, wherein the outside surface of said hollow tubular element comprises a curved surface following the contour of said interior surface.

30. The stabilizing fin of claim 16, wherein the circumference of the first end is larger than the circumference of the second end, and wherein the circumference of the tube between said first and second ends exceeds the circumference at either said first end or said second end, and wherein the interior surface of said hollow tubular element forms a curved surface between said first and said second ends.

31. The stabilizing fin of claim 30, wherein the circumference of said tubular element between said first end and said second end exceeds the circumference of the tubular element at both said first end and said second end.

32. A stabilizing element for a mobile device comprising:

a hollow tubular element having an open first end and an open second end, wherein the circumference of the first end is larger than the circumference of the second end, and wherein the circumference of the tubular element between said first and second ends exceeds the circumference at either said first end or said second end, and wherein the interior surface of said hollow tubular element forms a curved surface between said first and said second ends, wherein said first end of said hollow tubular element comprises a rounded edge and wherein said second end of said hollow tubular element comprises a tapered edge.

33. The stabilizing element of claim 32, further comprising a first vertical stabilizer element extending from a first portion of said hollow tubular element.

34. The stabilizing element of claim 33, further comprising a second vertical stabilizer element extending from a second portion of said hollow tubular element, one of said first or second vertical stabilizer elements being attached to said mobile device.

35. The stabilizing element of claim 34, wherein said first stabilizer element, said hollow tubular element and said second stabilizer element are integrally connected.

36. The stabilizing element for a mobile device of claim 32, wherein said first end is the front end of said hollow tubular element and wherein said second end is the rear end of said hollow tubular element.

37. The stabilizing element for a mobile device of claim 32, wherein said first end is the back end of said hollow tubular element and wherein said second end is the front end of said hollow tubular element.

38. The stabilizing element for a mobile device of claim 32, wherein said hollow tubular element has a substantially circular cross-section.

39. The stabilizing element of claim 32, wherein the mobile device is an airplane.

40. The stabilizing element of claim 32, wherein the mobile device is an automobile.

41. The stabilizing fin of claim 32, wherein the circumference of the tubular element between said first end and said second end exceeds the circumference of the tubular element at both said first end and said second end.

42. A stabilizing element for a mobile device comprising:

a hollow tubular element having an open first end and an open second end, wherein the circumference of the first end is larger than the circumference of the second end, and wherein the circumference of the tubular element between said first and second ends exceeds the circumference at either said first end or said second end, and wherein the interior surface of said hollow tubular element forms a curved surface between said first and said second ends, wherein said hollow tubular element has a substantially elliptical cross-section.

* * * * *